US007926237B2

(12) United States Patent
Gerkes et al.

(10) Patent No.: US 7,926,237 B2
(45) Date of Patent: Apr. 19, 2011

(54) CEILING OR WALL PANEL

(75) Inventors: Martin Daniel Gerkes, Toronto (CA); Heikki Kolga, Maple (CA); Ronald White, Holland Landing (CA)

(73) Assignee: Decoustics Limited, Woodbridge, ON (CA)

( * ) Notice: Subject to any disclaimer, the term of this patent is extended or adjusted under 35 U.S.C. 154(b) by 760 days.

(21) Appl. No.: 11/878,012

(22) Filed: Jul. 20, 2007

(65) Prior Publication Data

US 2008/0047214 A1 Feb. 28, 2008

(51) Int. Cl.
*E04B 9/12* (2006.01)
*E04B 9/22* (2006.01)

(52) U.S. Cl. ..... 52/506.03; 52/506.05; 52/506.06; 52/506.08; 52/220.6; 52/507

(58) Field of Classification Search ..... 52/309.1, 52/309.4, 309.6, 309.7, 309.11, 309.16, 506.1, 52/506.03, 506.05, 506.06, 506.08, 506.09, 52/220.1, 220.6, 287.1, 261, 272, 506.01, 52/506.04, 507–513, 716.8, 718.06, 718.04
See application file for complete search history.

(56) References Cited

U.S. PATENT DOCUMENTS

| | | | | |
|---|---|---|---|---|
| 2,401,906 | A * | 6/1946 | Burnett et al. | 52/406.2 |
| 4,034,513 | A * | 7/1977 | Richardson | 49/504 |
| 5,678,383 | A * | 10/1997 | Danielewicz | 52/775 |
| 6,499,262 | B1 * | 12/2002 | Pinchot et al. | 52/273 |
| 6,959,520 | B2 * | 11/2005 | Hartman | 52/838 |
| 2006/0117726 | A1 * | 6/2006 | Moreno | 55/495 |

FOREIGN PATENT DOCUMENTS

JP 07331899 A * 12/1995

* cited by examiner

*Primary Examiner* — Jeanette E. Chapman

(57) ABSTRACT

A wall or ceiling panel secures a grid insert, preferably of an architectural metal mesh, within a frame using a series of spring clips. The spring clips engage the metal mesh and are retained in a securing slot provided at an interior edge of the panel frame. Each spring clip includes at least one engagement member that passes through and engages the grid insert. The spring also includes a securing base that is received and retained within the securing slot of the frame. The panel can also include a securing arrangement for supporting the grid member at a position spaced from the frame to avoid downward bowing of the metal mesh.

16 Claims, 6 Drawing Sheets

CEILING OR WALL PANEL

FIELD OF THE INVENTION

The present invention relates to ceiling or wall panels and in particular, to panels having a grid insert as a finished face of the panel and secured by a series of clips received and retained in a securing slot provided at an inner edge of the frame. Preferably, the frame of the panel has a thin edge profile at the front face to form a "frameless" panel.

BACKGROUND OF THE INVENTION

Frameless ceiling and wall panels are well known and accepted in the marketplace. A number of these "frameless" panels include a cloth finished surface which is stretched over a frame and attached to the sides or back of the frame. With this arrangement, the frame is not exposed between abutting panels. The frames are generally "L" shaped with a securing flange projecting inwardly from one arm of the frame to engage and retain an acoustical dampening material insert filling the frame.

A number of metal meshes for architectural products are available from different manufacturers including Potter & Soar Ltd. and Banker Wire. These metal meshes have a functional and/or decorative finish and have been secured within a frame to form various surfaces including panels. The panels using these meshes have not been of the frameless type. Typically, the metal meshes have been mechanically secured or welded to a frame and the metal mesh does not extend across essentially the full width of the panel.

It is desirable to use these heavy metal meshes which are typically welded metal meshes to provide a finished surface for a ceiling or wall panel. These metal meshes are quite heavy and therefore, good mechanical securement of the mesh to the panel frame is critical. A simple effective securement arrangement is required to all the panel to be produced efficiently.

The present invention provides a simple effective arrangement for securing of these metal meshes to a frame member including a "frameless" type frame.

SUMMARY OF THE INVENTION

A ceiling or wall panel according to the present invention has a frame having a front face and a rear face with a grid insert secured at the periphery of the frame and forming a finished surface of the panel. The grid insert is secured at the periphery of the frame by plurality of clips where each clip includes at least one engagement member that passes through the grid insert and engages a grid member thereof. Each clip also includes a securing base that is received and retained in a securing slot provided at an upper edge of the frame.

In a preferred embodiment of the invention, the frame at the front face includes a thin outer member perpendicular to the finished surface of the panel and the grid insert extends to a thin outer member of the frame to form a frameless panel.

In a further aspect of the invention, the securing slot is formed interior to the panel and is recessed relative to the finished surface to accommodate the grid insert.

In a further aspect of the invention, the securing slot is recessed below a finished face of the panel, a distance sufficient to accommodate the thickness of the grid insert and provides a rear support surface for the grid insert.

In a different aspect of the invention, an insert of acoustical dampening material is secured within the frame and provides a rear support surface for the grid insert.

In a further aspect of the invention, a decorative veil substrate is provided between the grid insert and the acoustical dampening material and is visible through the grid insert.

In a preferred aspect of the invention, the grid insert is a welded wire mesh.

In yet a further aspect of the invention, the clip includes a bent bar retaining member for engaging the grid inserted at two space positions with each bent bar retaining member being retained in the securing base of the clip.

In a further aspect of the invention, the ceiling or wall panel includes at least one intermediary member extending across a rear face of said frame and at least one wire member engaging a front face of said grid insert at an interior position spaced from the frame. The wire member passes through the dampening material and engages one of the intermediary members to provide intermediary support of the grid insert within the frame.

In yet a further aspect of the invention, the wire member engages an adjustable member rotatably supported by the intermediate member. The adjustable member, when rotated, adjusts a length of the wire member to draw the grid insert towards and against the acoustical dampening member.

BRIEF DESCRIPTION OF THE DRAWINGS

Preferred embodiments of the invention are shown in the drawings, wherein.

DETAILED DESCRIPTION OF THE PREFERRED EMBODIMENTS

The ceiling or wall panel 2 is typically at least one meter square. As the size of the panel increases, the weight of the panel increases and this is normally the prime considerations with respect to size. For example, a 1.2 meter square with a welded wire mesh front face, can weigh in the order of 50 to 55 lbs. As ceiling panels are installed overhead, this is the approximate weight that a workman can install without additional assistance.

Woven metal fabrics are produced in various weights, textures, degrees of transparency and flexibility. They are typically manufactured out of non-corroding high grade AISI type 316 stainless steel (standard) although alternate stainless materials are chosen for specific environments. Woven metal fabrics that can be incorporated into panels as grid inserts include: Capella by GKD and Caspian by Potter and Soar.

Figure 1:
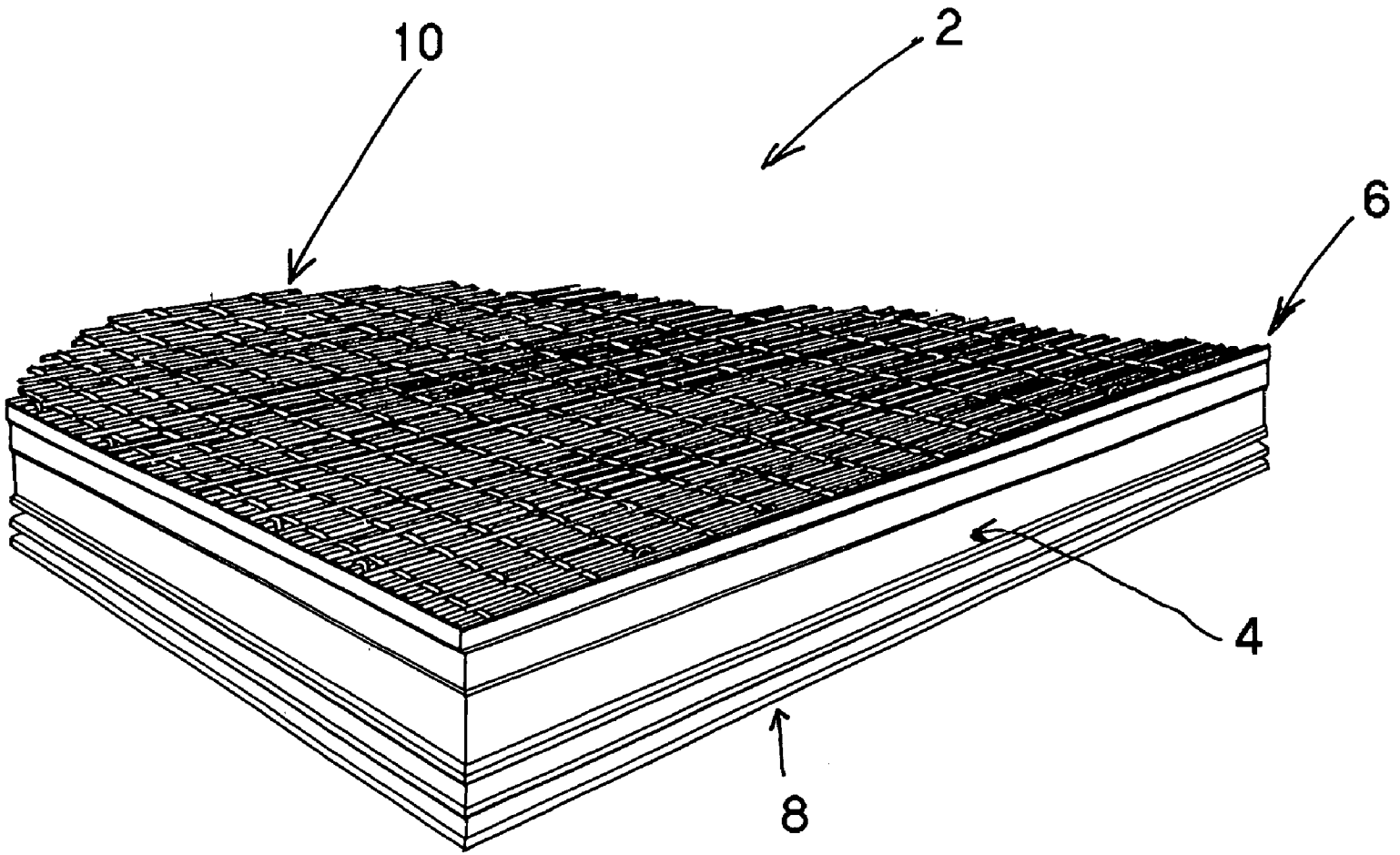
FIG. 1 is a partial perspective view of the ceiling or wall panel having a grid insert.

The various architectural metal meshes are relatively heavy and come in a variety of patterns and configurations. As evident from FIG. 1, the wire mesh extends to the edge of the panel and only a thin edge 6 of the panel frame is visible at the finished surface. The wire mesh or grid member 10 extends essentially across the finished surface of the panel. The frame 4 provided about the panel extends inwardly to form a rear surface 8 and provides additional stiffness. The frame comprises a series of connected members 30 of the same cross section. The interior port 11 receives a connecting element used to secure adjacent connected members 30.

Figure 2:
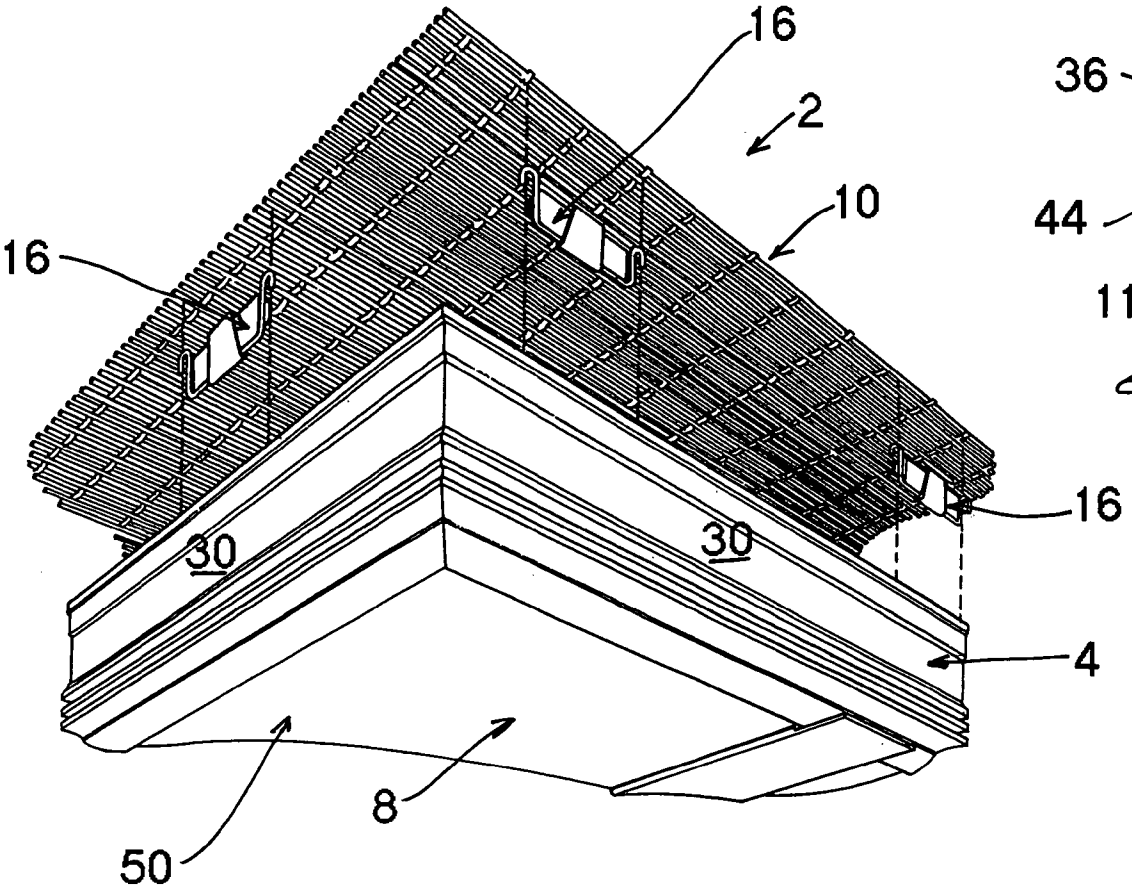
FIG. 2 is a partial exploded perspective view of the ceiling or wall panel with the grid insert spaced from the securing frame.

The panel 2 shown in FIG. 2, has a rear surface 8 and the frame 4 is defined by the connected frame members 30 of a generally "L" shape. Preferably, an acoustical dampening material 50 is provided within the frame. FIG. 2 shows a series of clips 16 which are received within securing slots 36 of the frame and positively secure the grid insert 10 to the frame.

Figure 3:
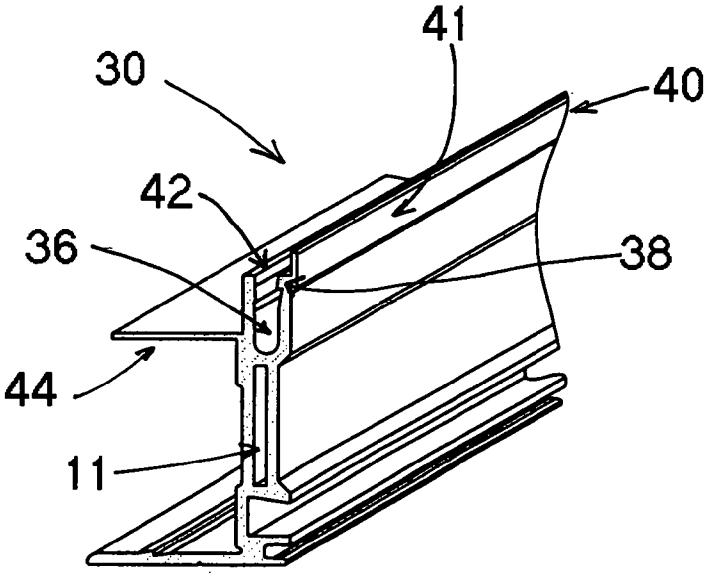
FIG. 3 is a partial perspective view of the extruded members used to form the frame of the panel.
Figure 4A:
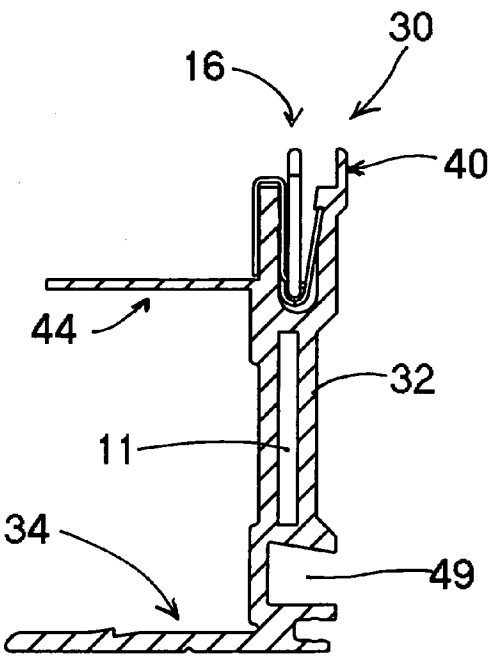
FIG. 4A is a cross sectional view through the framing member with a securing clip engaging the frame member and FIG. 4B is a partial enlargement of FIG. 4A.
Figure 4B:
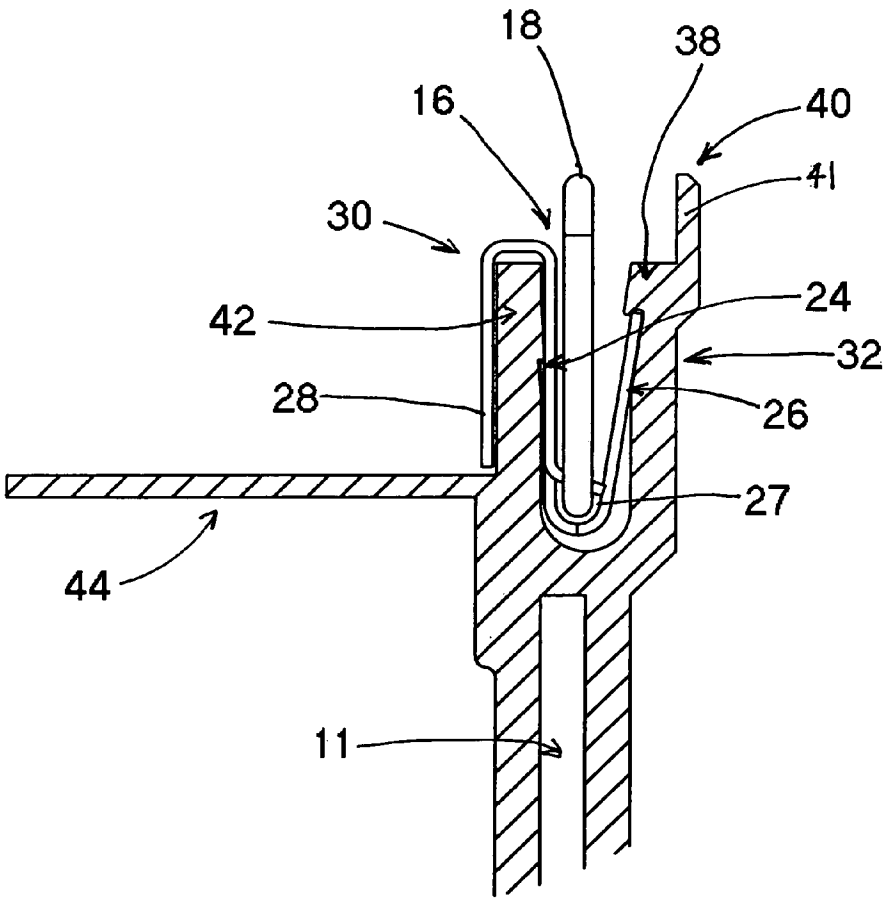
Figure 5:
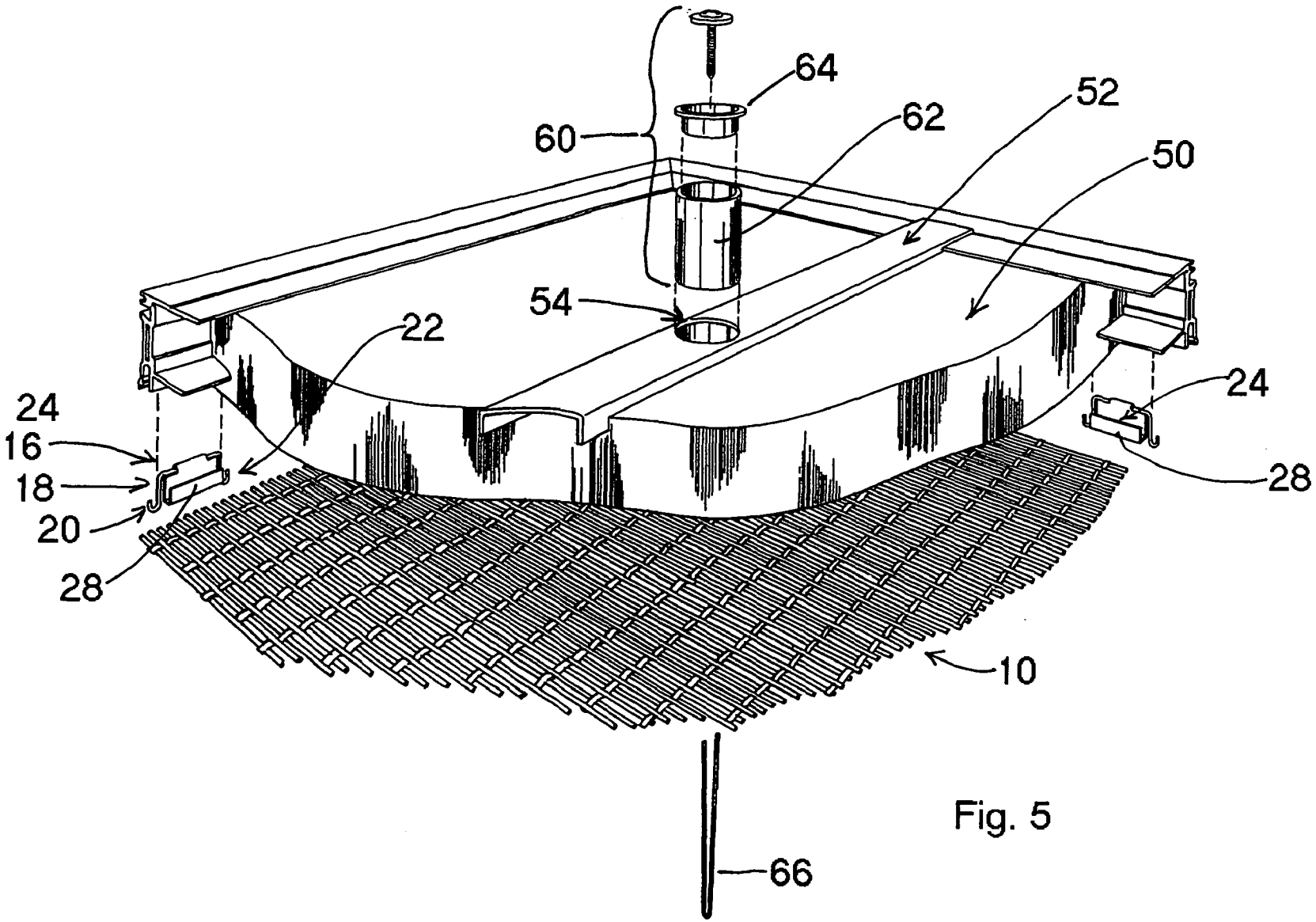
FIG. 5 is a partial exploded perspective view of the panel showing additional details of a method for securing of the grid member intermediate the sides of the panel.

Each of the frame members 30, shown in the partial perspective view of FIG. 3 and the cross sectional views of FIGS. 4A and 4B, has a distinctive profile. The frame member 30 has a first arm 32 forming the side of the frame and a second arm 34 provided at the rear of the frame. The first arm includes at an upper edge, the securing slot 36 which is provided to the interior of the frame member. This securing slot includes a latch edge 38 for engaging and retaining the securing clips 16. Each frame member 30 also preferably includes the inwardly projecting securing flange 44 which is received in a side slot of the acoustic dampening material. This also serves to secure the acoustical dampening material within the frame and stiffens the panel.

Preferably, frame members 30 include spline receiving slot 49 that allows the frame members 30 to also be used in the manufacture of cloth covered panels. The cloth is wrapped around the sides of the frames and a spline is forced into slot 49 to retain the fabric or fine screen material drawn across the panel.

Securing slot 36 is slightly recessed relative to the front face of the panel as shown at 42. This downward recess of the securing slot corresponds generally to the thickness of the wire grid insert. Thus, the wire grid insert is retained within the periphery of the frame and the frame includes a slight side extension shown as 41 such that the edges of the grid member are not exposed. It can also be appreciated that this particular arrangement provides the frameless look where grid insert 10 extends essentially from side to side of the panel and the ends of the grid insert are covered by the side extension 41.

FIG. 4B also illustrates the securing clip 16 received in the securing slot 36.

Figure 10:
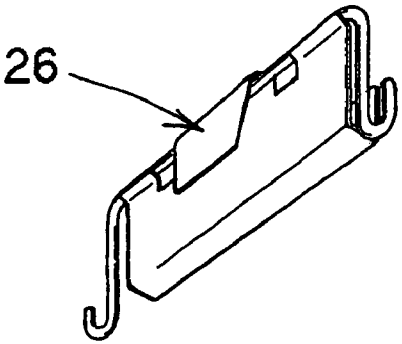
FIG. 10 shows the assembled bar retaining member and the base member of the clip.
Figure 9:
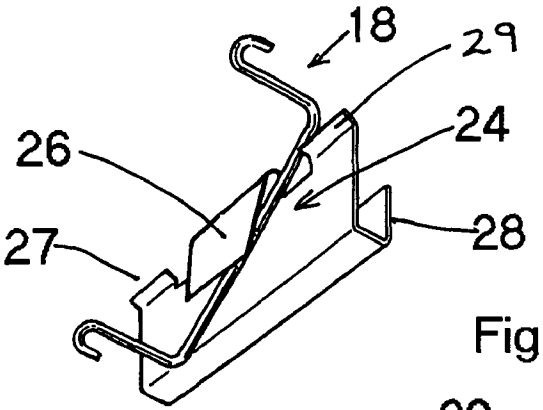
FIG. 9 is a perspective view showing the base member of the securing clip receiving a bar retaining member.
Figure 8:
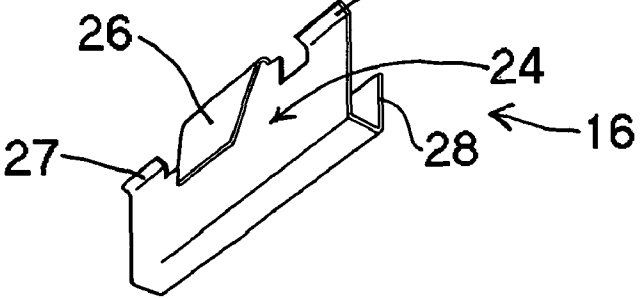
FIG. 8 is a perspective view of the base portion of the securing clip.
Figure 11:
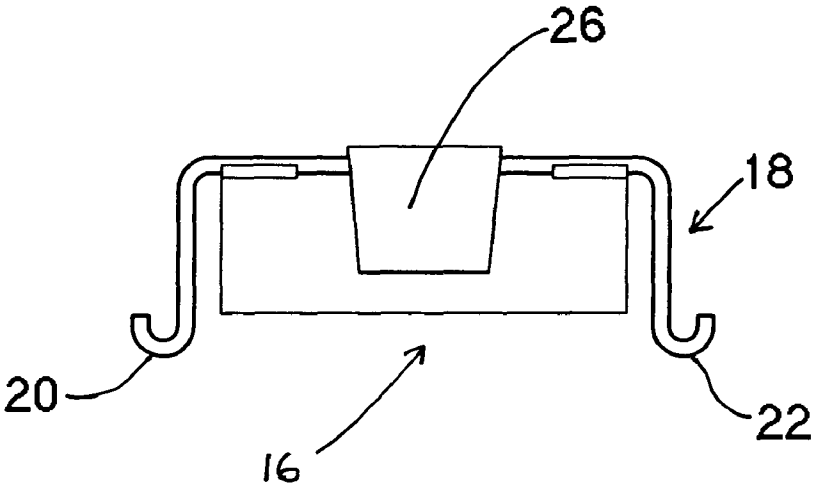
FIG. 11 is a front view of the assembled clip of FIG. 10.

Details of the securing clip 16 are shown in FIGS. 8 through 11. The securing clip includes a securing base 24 having a spring flange 26 projecting from one side thereof, and a securing guide 28 positioned to the opposite side of the base 24. The spring flange 26 also includes securing tabs 27 and 29 positioned either side of the spring flange 26. As shown in FIG. 10, the bent bar member 18 is retained at the connection of the spring flange 26 and the base member 24 by the retaining flanges 27 and 29. The bent bar 18 is pivotally retained in the securing base 24, as shown in FIG. 9, by initially placing the bent bar to one side of a securing tab shown as 29, with the bar then being pivoted counterclockwise, so that the bar cams past and is retained behind the retaining flange 27. This provides a simple arrangement for securing of the bent bar 18 to the base 24. It also allows pivoting of the bar member if necessary.

The securing guide 28 slides over and is retained on an inner edge of the securing slot is exposed within the securing slot 36. In contrast, the securing base 24 and the spring flange 26 are inserted within the slot. The spring flange 26 when inserted into the securing slot, cams past the latch edge 38 of the securing slot 36 and is retained therebehind. The bent bar member 18 with its "U" shaped engaging members 20 and 22, provide at opposite sides of the clip 16, engages the individual bar insert of the grid member 10 and positively secures the periphery of the grid insert to the frame.

In many applications, it is also desirable to have a thin vale substrate between the grid member and the acoustical dampening member. This veil substrate can provide a finished colored surface for the panel that matches the grid insert or complements the grid member.

The architectural metal meshes are often stiff in one direction, and bendable or hingeable in a perpendicular direction. These metal meshes or grid members are not normally rigid in both directions and bow downwardly if the panel is large and intermediate support is not provided.

Figure 7:
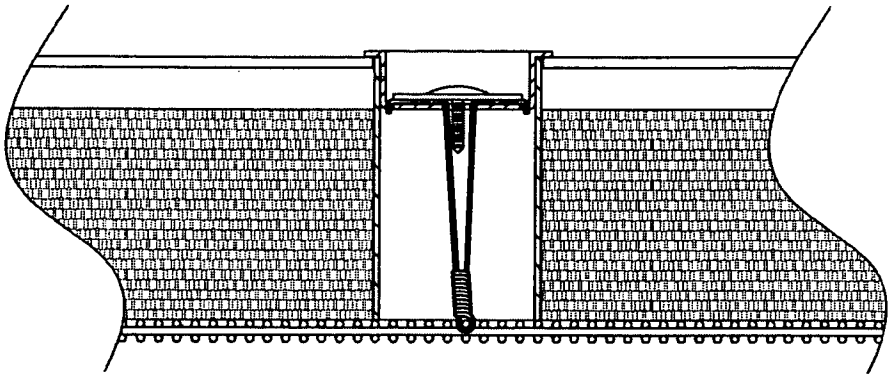
FIG. 7 is a cross sectional view through the adjustment mechanism.
Figure 6:
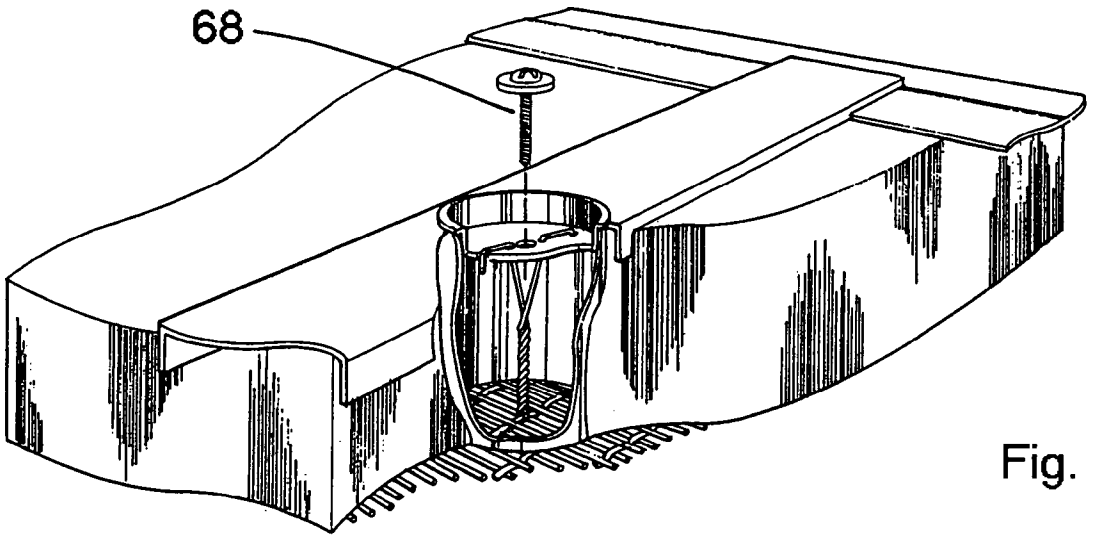
FIG. 6 is a partial perspective cutaway view showing an adjustment mechanism for securing of the grid at an intermediary position within the panel.

As previously described, the grid insert can have a tendency, particularly in large panels to bow downwardly. In order to overcome this problem, a number of intermediary supports 52 extend across the rear surface of the panel and have a series of securing positions 54 for engaging the grid insert intermediary the sides of the panel. An adjustment mechanism 60 is shown which includes a collar member 62, a rotatable cap member 64 received within the collar 62, and a wire member 66. The acoustical dampening material 50 can be drilled and the intermediary member 52 can also be drilled to receive the collar 62. The collar 62 is used to define a desired spacing of the grid member 10 from the rear face of the intermediary 52. The wire member 66 is inserted to engage one of the bar members of the grid insert 10 and passes through a port in the acoustical dampening material. The collar 62 includes a series of slots or ports to allow the two segments of the wire member 66 to pass through the collar and be returned to the cavity within the sleeve. Details of this are shown in the partial perspective view of FIG. 6 and the sectional view of FIG. 7.

The collar 66 as shown includes four ports for receiving of the wire member 66. A screw member 68 is inserted into the collar 64 is tightened against the collar to lock the wire segments to the collar. Further rotation of the screw member 68 rotates collar 64 and winds the wire segments within the collar sleeve and draws the grid insert upwardly. The purpose of the collar sleeve is to fix the extent of the adjustment, such that the grid insert is planar within the frame.

This particular arrangement has proven effective in securing heavy gauge meshes and welded wire mesh. The use of the double segment wire member 66 engaging a member of the grid insert provides a simple connection arrangement. The connection of these segments to the rotatable collar supported by an intermediary support also provides a simple adjustment mechanism. The use of the collar sleeve may not be necessary for some applications.

In addition, other methods of intermediate support can be used including a single segment wire member with one end attached to the grid insert. Various arrangements for securing of the single wire segment to the intermediate support can be used.

The architectural mesh finished panel with the acoustical dampening material secured in the frame provides good sound absorbing properties. Depending upon the particular mesh used, a decrease in sound absorption of 10% or less, relative to a cloth faced panel, could be expected. Thus, the acoustical properties of the panel are good for most applications.

For example, this type of panel with a TYPE A mount had a NRC rating of 0.90 and a SAA rating of 0.92. With a TYPE E400 mount, the NRC rating was 0.90 and the SAA rating was 0.94.

The invention has been described and is preferably used with a frameless panel, however, it can be appreciated that it is also suitable for use with frames that are not frameless. In this case, the securing slot would be provided at an inner edge and suitably supported.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A ceiling or wall panel comprising a frame having a front face and a rear face, a grid insert extending across said front face; said grid insert being secured at the periphery of said frame and forming a finished surface of said panel, said grid insert being secured at the periphery of said frame by a plurality of clips where each clip includes at least one engagement member that passes through said grid insert and engages a grid member thereof on said front face and a securing base that is received and retained in securing slot provided at an inner edge of said frame; and wherein each clip includes a bent bar retaining member for engaging said grid insert at two spaced positions with said bent bar retaining member being retained in said securing base.

2. A ceiling or wall panel as claimed in claim 1 wherein said frame at said front face includes a thin outer member perpendicular to said finished surface of said panel and said grid insert extends to and terminates at said thin outer member to form a frameless panel.

3. A ceiling or wall panel as claimed in claim 2 wherein said securing slot is formed interior to said panel and is recessed relative to said finished surface to accommodate said grid insert.

4. A ceiling or wall panel as claimed in claim 2 wherein said securing slot is recessed below said finished face sufficient to accommodate the thickness of said grid insert and provides a rear support surface for said grid insert.

5. A ceiling or wall panel as claimed in claim 4 including an insert of acoustical dampening material secured within said frame and providing a rear support surface for said grid insert.

6. A ceiling or wall panel as claimed in claim 5 wherein said panel includes a decorative substrate between said grid insert and said acoustical dampening material visible through said grid insert.

7. A ceiling or wall panel as claimed in claim 1 wherein said grid insert is a welded wire mesh.

8. A ceiling or wall panel as claimed in claim 5 wherein said grid insert is a welded wire mesh.

9. A ceiling or wall panel as claimed in claim 8 wherein said panel is of a size of at least three feet by three feet.

10. A ceiling or wall panel as claimed in claim 1 wherein said bent bar retaining member is "U" shaped with two grid engaging end portions on opposite arms of said "U" shaped retaining member.

11. A ceiling or wall panel as claimed in claim 10 including at least one intermediary member extending across said frame and at least one Wire member engaging a front face of said grid insert at an interior position spaced from said frame; said wire member passing through said acoustical dampening material and engaging one of said intermediary members to provide intermediary support of said grid insert within said frame.

12. A ceiling or wall panel as claimed in claim 11 wherein said wire member engages an adjustable member rotatably supported by said intermediary member, said adjustable member when rotated adjusting a length of said wire member to draw said grid insert towards and against said acoustical dampening member.

13. A ceiling or wall panel as claimed in claim 11 wherein said panel includes at least two intermediary members and at least 4 wire members each providing intermediary support of said grid insert.

14. A ceiling or wall panel as claimed in claim 5 wherein said frame has a series of connected extruded members and each extruded member has two arms joined to form an "L" shape with one arm defining a side of said extruded member and the other arm forming a rear of said extruded member; said side of extruded member including a recessed interior slot opening to the front of said panel to form said securing slot of said frame.

15. A ceiling or wall panel as claimed in claim 14 wherein each extruded member has a clip engaging latch edge projecting partially into said slot at the opening thereof.

16. A ceiling or wall panel as claimed in claim 15 wherein each extruded member includes at an intermediary position of said one arm, a securing flange projecting inwardly from said securing slot and generally parallel to said other arm that engages and supports aid acoustical dampening material.

* * * * *